US008505180B2

(12) United States Patent
Kewing

(10) Patent No.: US 8,505,180 B2
(45) Date of Patent: Aug. 13, 2013

(54) REBUILT WINDING CORES AND METHOD OF MANUFACTURE

(76) Inventor: Daniel Kewing, Brantford (CA)

( * ) Notice: Subject to any disclaimer, the term of this patent is extended or adjusted under 35 U.S.C. 154(b) by 978 days.

(21) Appl. No.: 12/576,312

(22) Filed: Oct. 9, 2009

(65) Prior Publication Data

US 2010/0102159 A1 Apr. 29, 2010

Related U.S. Application Data

(60) Provisional application No. 61/107,788, filed on Oct. 23, 2008.

(51) Int. Cl.
*B23P 6/00* (2006.01)

(52) U.S. Cl.
USPC ..... 29/402.11

(58) Field of Classification Search
USPC ..... 29/402.01, 402.03, 402.04, 402.05, 29/402.09, 426.1, 426.4, 426.6, 428, 453, 469, 505, 506, 516, 402.11; 242/613
See application file for complete search history.

(56) References Cited

U.S. PATENT DOCUMENTS

2006/0108789 A1* 5/2006 Hughes ..... 285/15

* cited by examiner

*Primary Examiner* — John C Hong

(57) ABSTRACT

A method of rebuilding used cores comprising the steps of; cutting a used core substantially down the center at a midway cut thereby creating a left core and a right core. Further installing an extension unit in between the left core and right core, thereby forming a lengthened rebuilt core. Further, cutting the damaged ends off the rebuilt core to a selected finished length. The rebuilt core includes a left core obtained from a donor core; a right core obtained from a donor core; an extension unit sandwiched between the left core and the right core for rigidly joining together the left and right cores by connecting to one end of each of the cores.

4 Claims, 12 Drawing Sheets

PRIOR ART

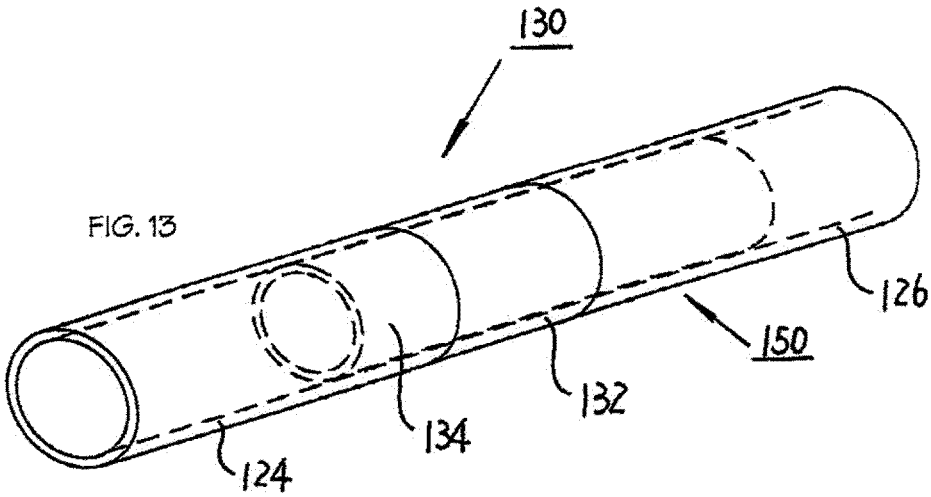
FIG. 13
FIG. 14
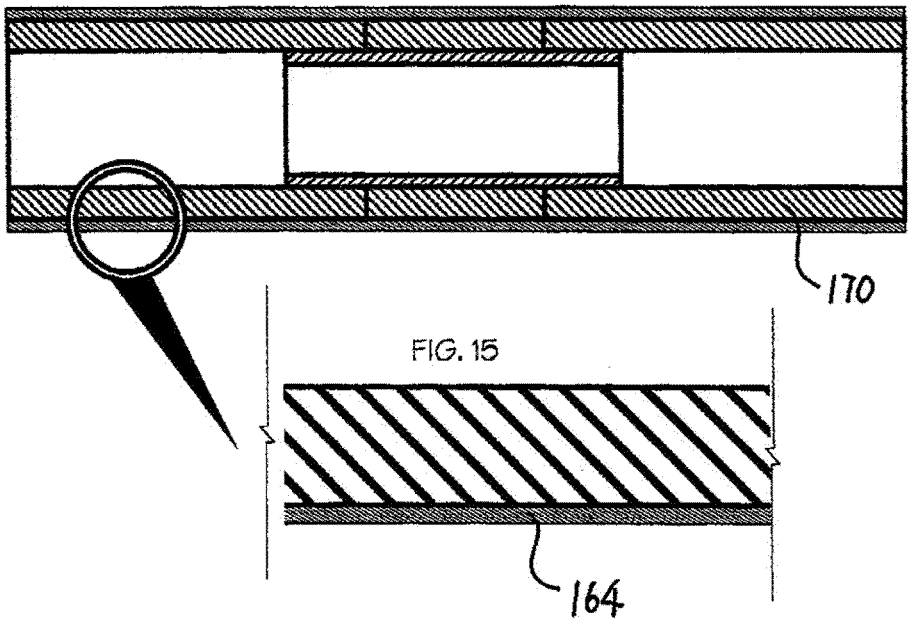
FIG. 15

REBUILT WINDING CORES AND METHOD OF MANUFACTURE

This application claims priority from regularly filed U.S. provisional application No. 61/107,788 filed Oct. 23, 2008 by Daniel Kewin under the title; Rebuilt Winding Cores and Method of Manufacture.

FIELD OF THE INVENTION

The present invention relates to spiral laminate paper board winding cores and more particular relates to rebuilt winding cores and their method of manufacture.

BACKGROUND OF THE INVENTION

It is well known in the art to collect for recycling or remanufacturing spiral laminate paper board winding cores used in the printing industry.

One such process for remanufacturing or recycling cores is discussed in U.S. Pat. No. 6,051,092 issued Apr. 18, 2000 to the inventors Gregg M. Lynch and Stuart Ostroff under the title Method and Apparatus for Recycling Cores.

There are a number of disadvantages to the process as described in U.S. Pat. No. 6,051,092 which will become clearer under the discussion of the prior art below.

It is an object of this apparatus and process to provide tubular core assemblies using a simple inexpensive process that is commonly commercially available in order that paper mills would have the ability to refurbish and/or rebuild cores in house.

It is another object of this invention to provide an apparatus and method for rebuilding cores which provides for a greater core strength and integrity than the heretofore devices and processes known in the art.

BRIEF DESCRIPTION OF THE DRAWINGS

The present device and method will be described by way of example only with reference to the following drawings in which:

FIG. 13 is a schematic partially cut away perspective view of a rebuilt core using an extension unit.

FIG. 14 is a side cross-sectional schematic view of a rebuilt core showing a thin outer wrap applied onto the surface.

FIG. 15 is an enlarged cross-sectional view of a portion of the side wall of the winding core shown in FIG. 14 with the outer wrap enlarged.

DETAILED DESCRIPTION OF THE PREFERRED EMBODIMENT

Figure 1:
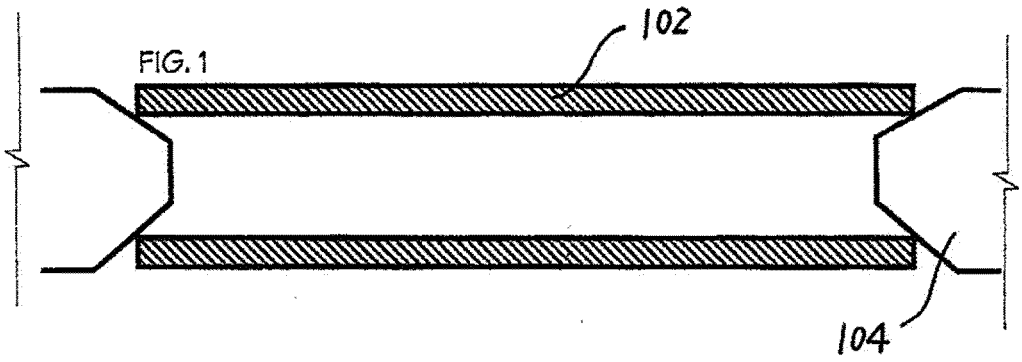
FIG. 1 is a side cross-section schematic view of a new spiral laminate paper board winding core mounted on stub chucks.

FIGS. 1 through 8 show the presently known prior art in technology used for the remanufacture, refurbishment or rebuilding of spiral laminate paper board winding cores. Referring to FIG. 1 a new spiral laminate paper board winding core 102 is shown mounted onto stub chucks 104. Alternatively new spiral laminate paper board winding core 102 may also be mounted onto a through shaft 105 shown in FIG. 2.

Figure 3:
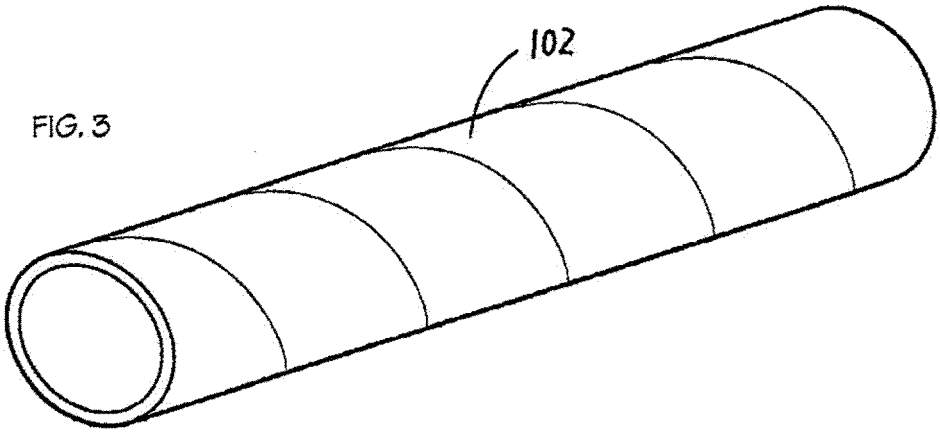
PRIOR ART FIG. 3
FIG. 3 is a schematic perspective view of a new spiral laminate paper board winding core.
Figure 4:
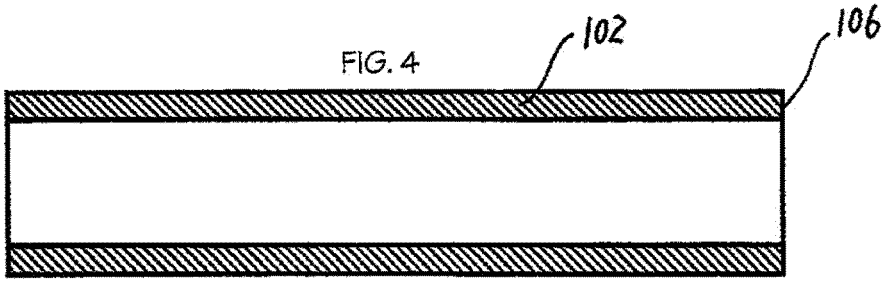
FIG. 4 is a side cross-sectional view of a new winding core.

FIG. 3 shows a new spiral laminate paper board winding core 102 prior to use in schematic perspective view.

Figure 2:
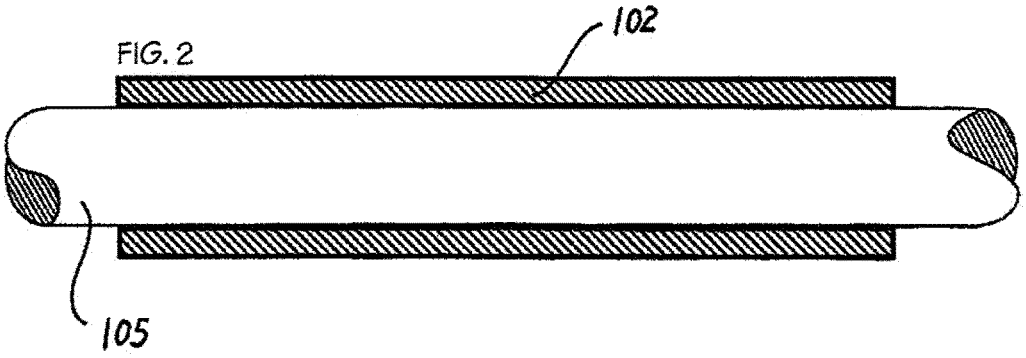
FIG. 2 is a schematic cross-sectional side view of a new spiral laminate paper board winding core mounted on a through shaft.

FIG. 2 shows a new spiral laminate paper board winding core 102 having a new undamaged end 106 prior to use.

Figure 5:
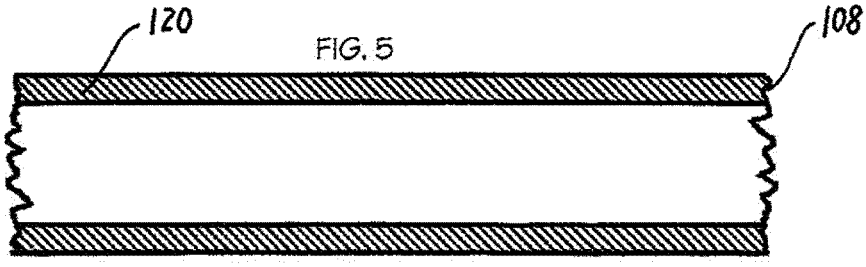
FIG. 5 is side cross-sectional view of a used winding core shown with damaged ends.

FIG. 5 is a spiral laminate paper board used core 120 shown with damaged ends 108. During use the stub chucks 104 will often slip and/or impart enough pressure onto the new ends 106 in such a manner that they become damaged creating damaged ends 108.

Figure 6:
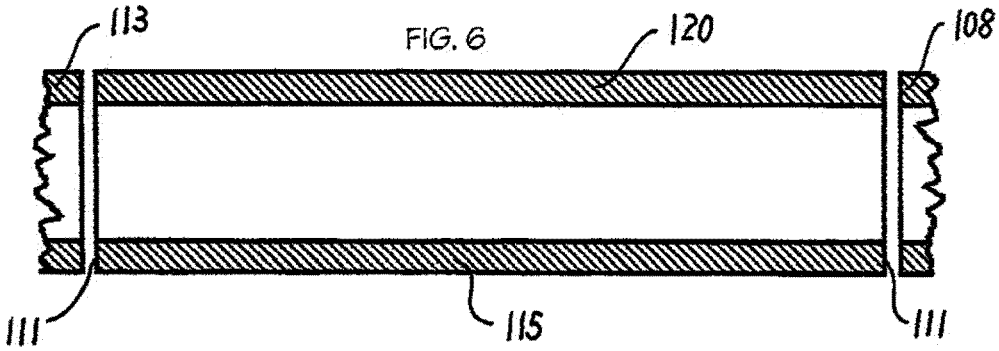
PRIOR ART FIG. 6
FIG. 6 is a schematic side cross-sectional view of a used winding core having the ends cut off.

FIG. 6 shows a used core 120 in which the damaged ends 108 are cut off at end cut 111 and a portion of the end namely end discard 113 is removed from the reclaimed portion 115 of the winding core.

Figure 7:
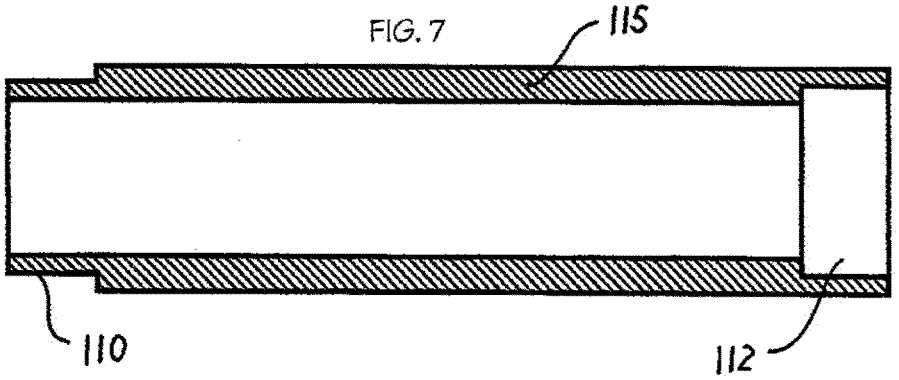
FIG. 7 is a side cross-sectional schematic view of a winding core with male and female lap connectors.

Reclaimed portion 115 as shown in FIG. 7, then undergoes a milling operation creating male and lap connector 110 and female end lap connector 112 which are milled in the opposite ends.

Figure 8:
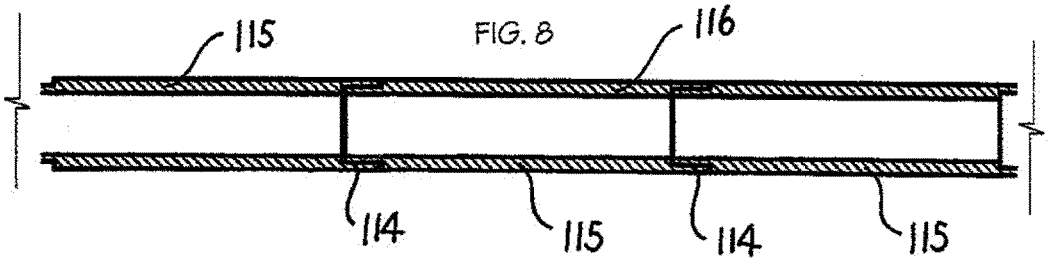
FIG. 8 is a side schematic cross-sectional view of a master refurbished winding core in accordance with the prior art.

FIG. 8 shows how these reclaimed portions 115 having male and female lap connectors 110 and 112 respectively are joined end to end in order to create a master refurbished winding core shown as 116 in FIG. 8. The reclaimed portions 115 are adhesively bonded together and then the master refurbished winding core 116 is cut to the desired length that is required for winding paper thereon. This design is based on the bonding strength of the male and female end adhesively joined ends which is a function of the overlap area and also the commercially viable mill depth of about 3" on the ends. This limits the maximum bonding area and the core sizes which can be restored to the original specification.

This bonding strength limitation is further reduced functionally by the random positioning of the milled joint. This results from joining several salvaged or reclaimed portions 115 of different length sequentially and then covering the joints and recuting the cores in random fashion to the required length. As a result the cut may in fact position itself right through the male end lap connector 110 and female end lap connector 112.

As a result these limitations reduce the core resistance to end compression and centre deflection in a variable and unpredictable manner which limits their reuse to low load winding and unwinding applications.

In addition, very specialized and expensive equipment is required in order to mill and assemble these winding cores and to put them back into usable condition.

This results in a single high volume plant which is centrally located to the mills requiring these winding cores. This creates a large amount of shipping back and forth between the end user and the refurbishing plant which increases the cost of refurbishing the winding cores.

Figure 9:
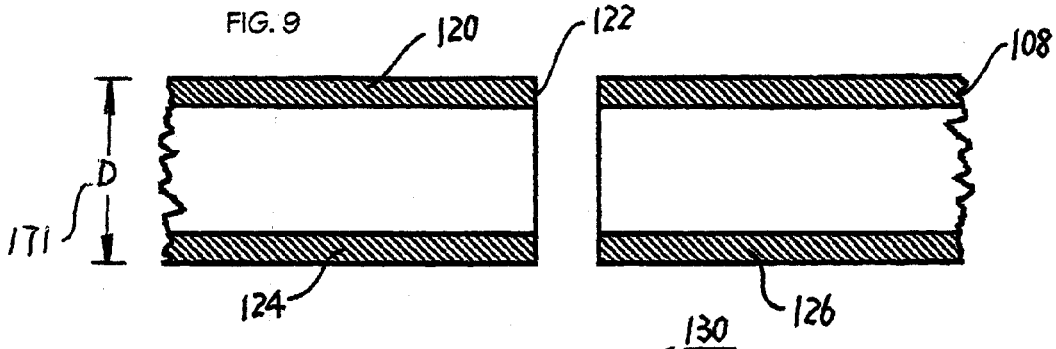
FIG. 9 is a schematic side cross-sectional view of a used core severed at approximately the midway point.

Now referring to the present device and method of rebuilding winding cores which is depicted in FIG. 9 and onwards. The reader will note that a single used or donor core may be used to produce a single rebuilt or refurbished core. All of the reclaimed portions may emanate from a single used donor core or from a mixture of multiple used cores. In the case of using a single donor core to produce a single rebuilt core the advantage obtained of ensuring uniform core characteristic including uniform dimensions, strength, materials and glues in the donor portions of a rebuilt core.

FIG. 9 depicts a used core 120 which may also be referred to as a donor core, is cut at a midway cut 122 creating a left core 124 and a right core portion 126. The left core 124 and right core 126 are spaced apart in order to accommodate an extension unit 130 which may include a spacer 132 and a joiner portion 134 producing a lengthened rebuilt core depicted in FIG. 10. Note midway cut 122 is defined for the purposes of this application as a cut placed within 30% of length of either side of the longitudinal center of a used core 120 when measured before the damaged ends have been removed. In other words midway cut 122 and the extension unit 130 is not within 20% by length of either end of the used core 120.

Figure 10:
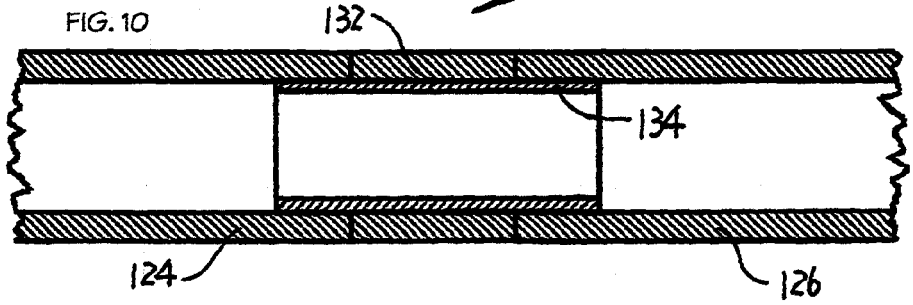
FIG. 10 is a schematic cross-sectional schematic view of a used core lengthened using an extension unit.

Once the winding core has been increased in length to beyond the finished length 151 by the insertion of the extension unit 130, the damaged ends 108 are cut at end cut 142 and the damaged portions namely end discard 140 is discarded. This leaves the central rebuilt core 150 which includes extension unit 130 and new undamaged ends cut to a finished length 151. Finished length is measured along the longitudinal direction of the core. The spacer 132 is for ensuring that the proper selected finished length 151 is obtained and for connecting the left and right cores 124, 126 and the joiner for reinforcing the connection between the left and right cores 124, 126. Extension unit 130 may be made as a single component. In FIG. 10 the extension unit is depicted with a radially outer spacer and a radially inner joiner. FIG. 10 shows a butt joint 163 between the left core 124 and the right core 126 and the spacer 132

Figure 12:
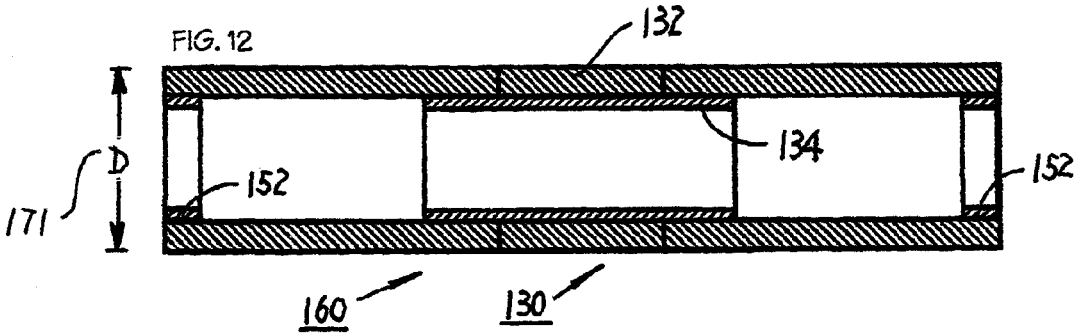
FIG. 12 is a schematic side cross-sectional view of a rebuilt core with insert collars.

FIG. 12 shows a winding core with originally installed insert collars 152 in the ends 153 thereby creating rebuilt core 160 having insert collars 152 provided therein. FIG. 13 shows schematically in perspective view rebuilt core 150 which includes the extension unit 130 comprised of a spacer 132 and a joiner 134 which adhesively joins together left core 124 to left core 126. The extension unit may be made of a single integral unit rather than from two separate components. The outer diameter of the used core is shown as D 171 and is substantially uniform. The outer diameter of the rebuilt core 160 D shown as 171 in FIG. 12 is substantially the same as the outer diameter D of the used core. Additionally the rebuilt cores must be of substantially uniform diameter along their length as shown in the figures.

The reader will immediately note that this system requires very inexpensive and commonly available equipment such as a band saw or any other simple cut off device in order to create the midway cut 122. Milling and/or grinding that is used to create the lap joints as in the prior art is not required and therefore the rebuilding of the core is simplified and the cost to rebuild the cores is reduced. Therefore cores can be rebuilt at in house facilities thereby also reducing shipping costs.

In addition the joint is contained to the centre portion of the rebuilt core 150 and therefore the end cuts 142 would never pass through the joint part namely, through the extension unit 130 of the rebuilt core 150. Additionally the end user receives back the same core which has been refurbished by adding an extension in the center of the core as described herein. In other words there is no mixing together of two or more used cores to produce one refurbished core. Using the presently described process and system one used core ultimately is refurbished into one refurbished core.

FIG. 14 shows that where specifications require a very smooth outer surface, it is possible to put an outer wrap 164 onto the surface of rebuilt core 150. The extension units described in this specification may be adhesively joined to one end of each of the left core 124 and right core 126 or may be joined or connected in any other manner known in the art including press fitting, screw fitting, mechanically joining, stapling, and adhesively bonding.

Figure 16:
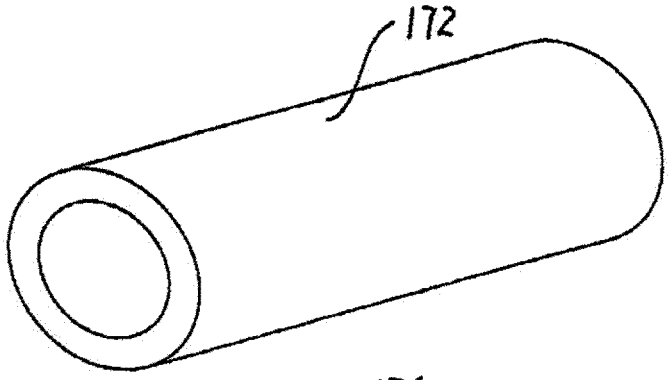
FIG. 16 is a side schematic perspective view of a fibre type joiner.
Figure 17:
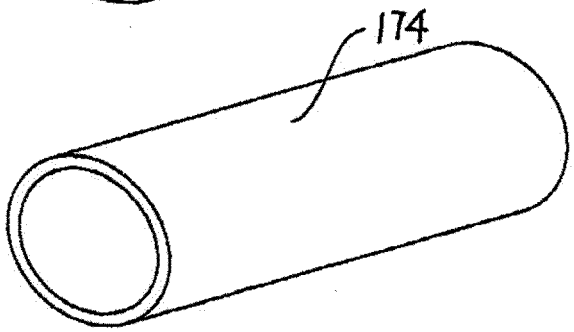
FIG. 17 is a side schematic perspective view of a plastic joiner.
Figure 18:
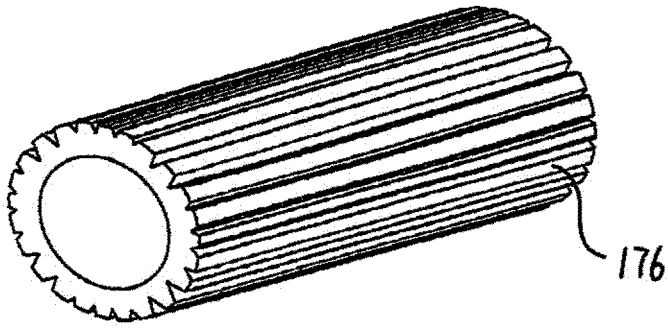
FIG. 18 is a side schematic perspective view of a splined joiner.
Figure 19:
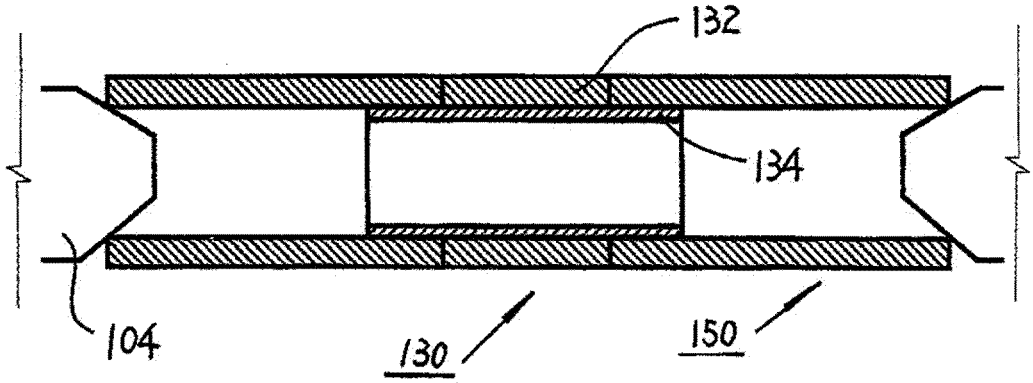
FIG. 19 is a schematic side cross-sectional view of a rebuilt core shown on stub chucks.
Figure 20:
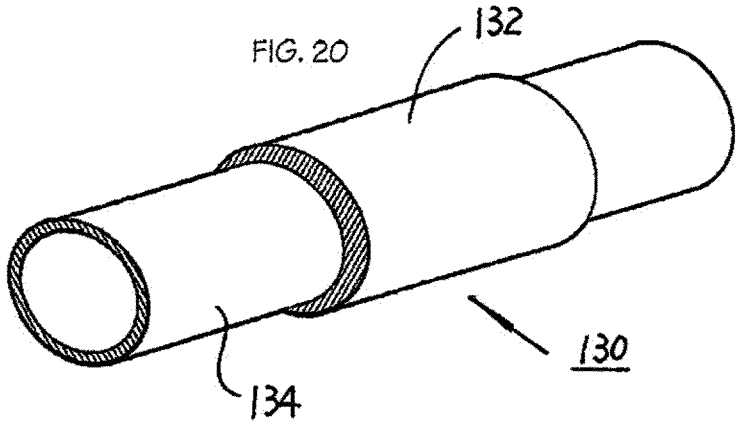
FIG. 20 is a side schematic perspective view of an extension unit.

FIGS. 16, 17 and 18 show different types of joiners that could be used in the rebuilding process, namely fibre joiner 172 or a plastic joiner 174 shown in FIG. 17 and/or a splined joiner 176 as shown in FIG. 18. The joiner could also be out of metal or any combination of these materials. FIG. 20 depicts an extension unit 130 which may be made up of a spacer 132 and a joiner 134. In practice extension unit 130 may be made as a single piece out of any suitable material including but not limited to paper, plastic, wood or metal.

The cutting of the used core 120 at midway cut 122 can be readily accomplished with commercially available equipment. The assembly of the spacer 132 and the joiner 134 is easily accomplished through commonly known adhesive joining techniques thereby greatly simplifying the assembly process and the refurbishment process.

Figure 21:
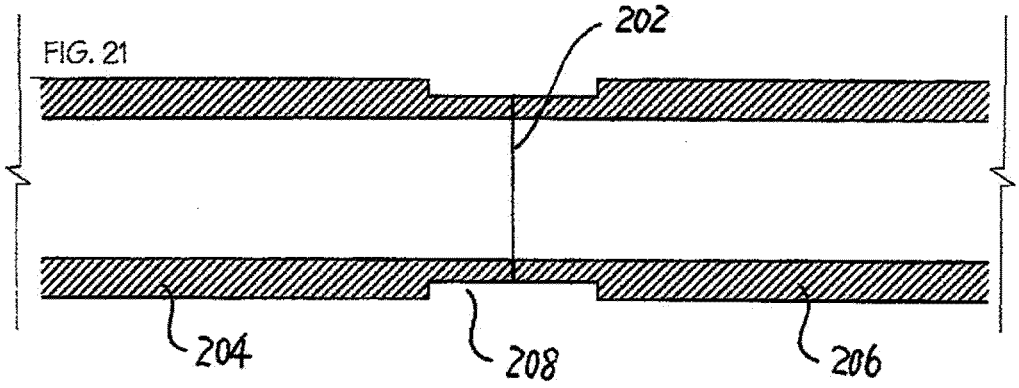
FIG. 21 shows an alternate embodiment of a rebuilt core in which the used core is milled approximate the midway cut with exterior lap cut outs.
Figure 22:
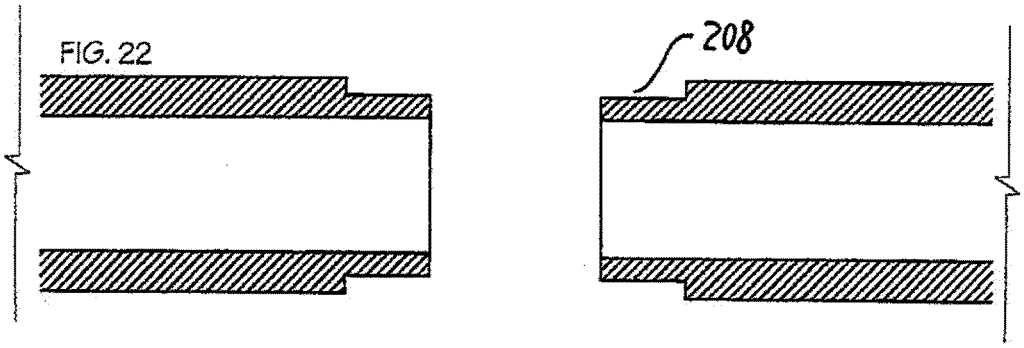
FIG. 22 shows the left core and right core of FIG. 21 separated.
Figure 23:
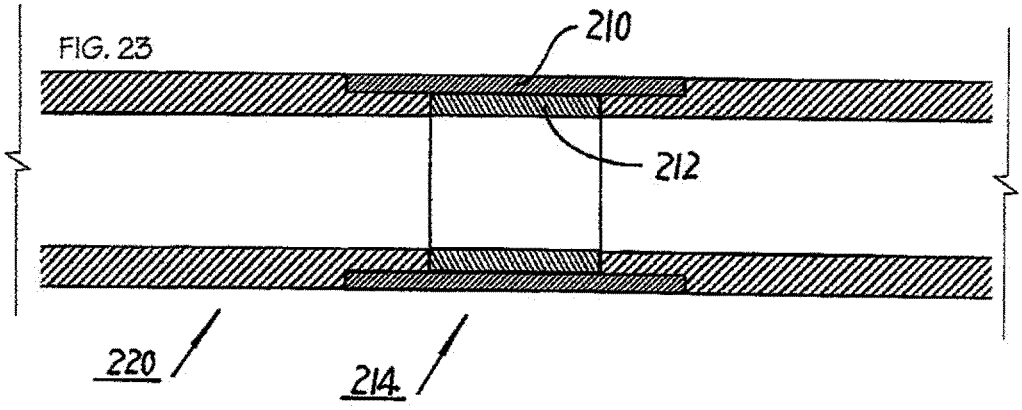
FIG. 23 shows a rebuilt core in accordance with this second embodiment with the extension unit in place.

Referring now to FIGS. 21 through 23 which show an alternate embodiment in which an exterior lap joint cut out 208 is removed proximate the midway cut 202 of the left core 204 and the right core 206. In this manner an outside joiner 210 and an inside spacer 212 are used to join left core 204 to right core 206. This type of rebuilt core 220 is particularly useful when a through shaft 105 is used to mount rebuilt core 220 onto the through shaft 105. Extension unit 214 is comprised of a joiner 210 and a spacer 212 as shown in FIG. 23.

Figure 24:
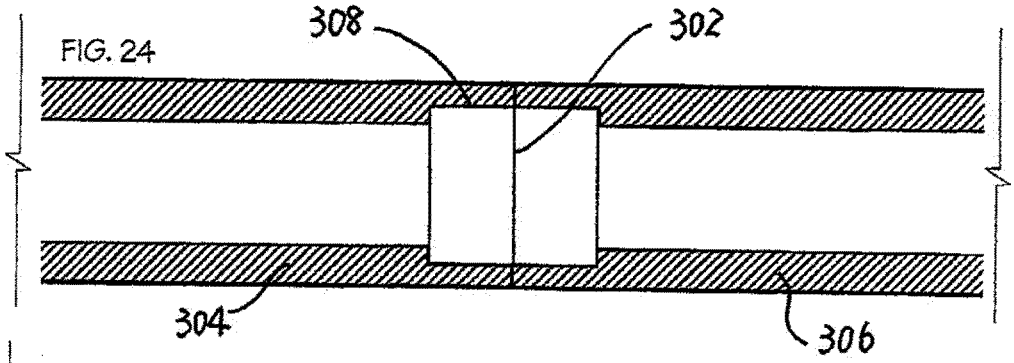
FIG. 24 is yet an alternate embodiment with the left core and the right core having an interior lap cut out approximate the midway cut.
Figure 25:
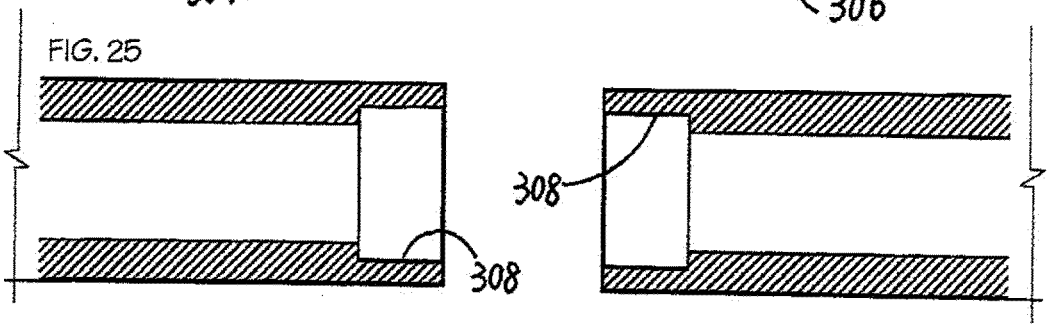
FIG. 25 is a side cross-sectional view of the left core and the right cores separated.
Figure 26:
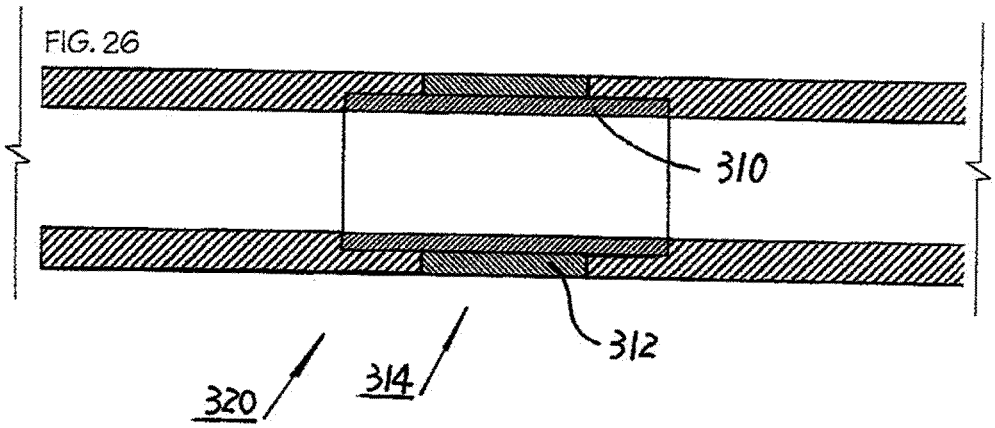
FIG. 26 is a side cross-sectional schematic view of the alternate embodiment a rebuilt core showing with the extension unit in place.

Yet another embodiment is shown in FIGS. 24 through 26 and in this case interior lap joint cut out 308 is removed into the interior of left core 304 and right core 306. In this case extension unit 314 includes an outer spacer 312 and an inner joiner 310 to produce rebuilt core 320 as shown in FIG. 26. Again this type of construction could be used when rebuilt core 320 is to be mounted onto a through shaft 104.

Figure 27:
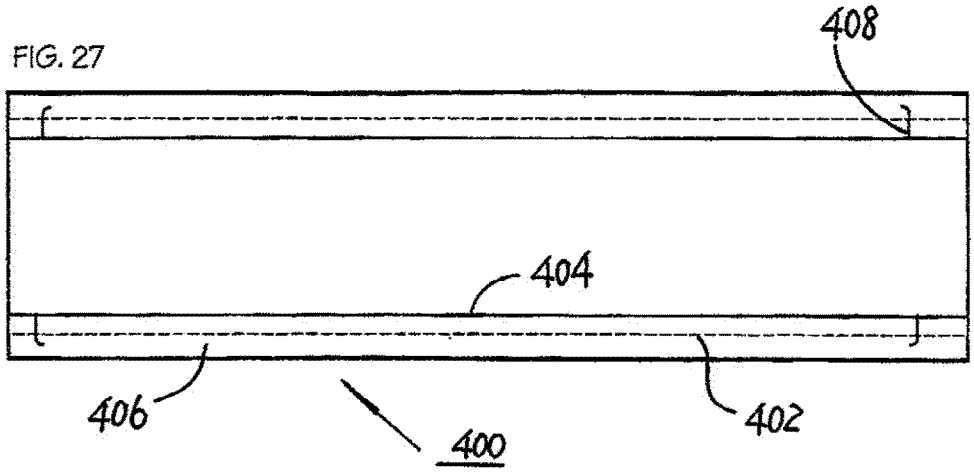
FIG. 27 is a side cross-sectional schematic view of an alternate spiral laminate paper core built from a separate inner core and an outer core fastened together with fasteners.
Figure 28:
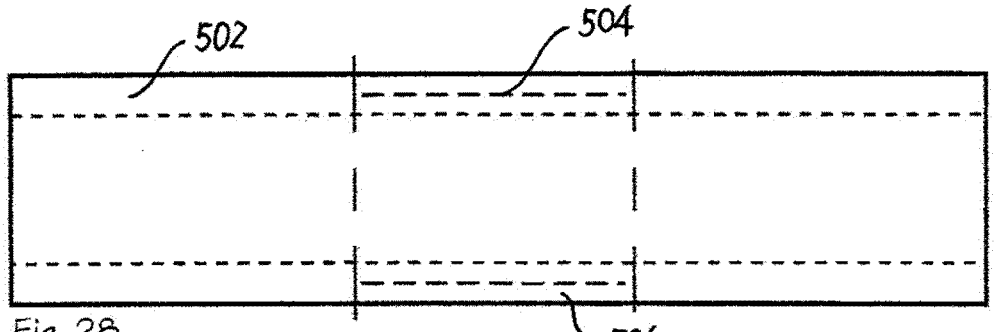
FIG. 28 is a side elevational schematic view of a new spiral laminate paper core having a central partial unglued parting line.
Figure 29:
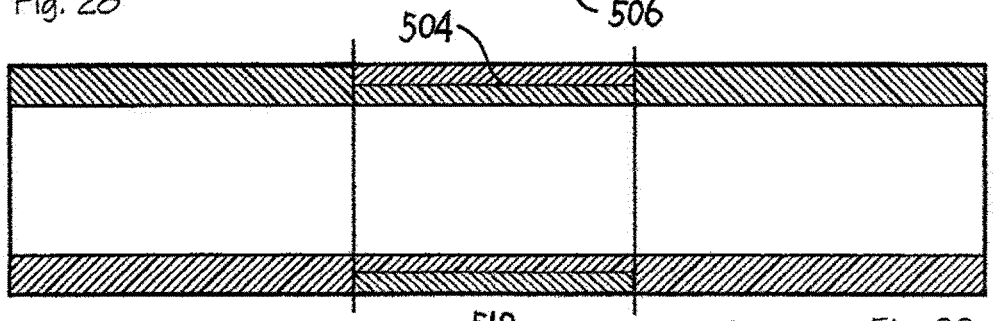
FIG. 29 is a side cross-sectional schematic view of a new spiral laminate paper core having a central partial unglued parting line.

FIG. 27 shows an alternate method of producing new spiral laminate paper board winding core namely split core as shown in 400. Split core 400 is manufactured from two separate cores namely, an outer core 406 which is normally wound unglued onto inner core 404. There may be other ways of making split core 400. There is a longitudinally extending unglued parting line 402 between the inner core 404 and the outer core 406 and the two cores are held together with fasteners 408 which in practice can be staples.

By using split core 400 having an inner core 404 and outer core 406 for rebuilt core construction simplifies the rebuilding, refurbishing process to create either exterior lap joint cut out 208 and/or interior lap joint cut out 308 as shown in FIGS. 21 and 24 respectively.

In those cases, the lap cut out is simply created by a simple exterior or interior radial cut to the split core 400.

Figure 11:
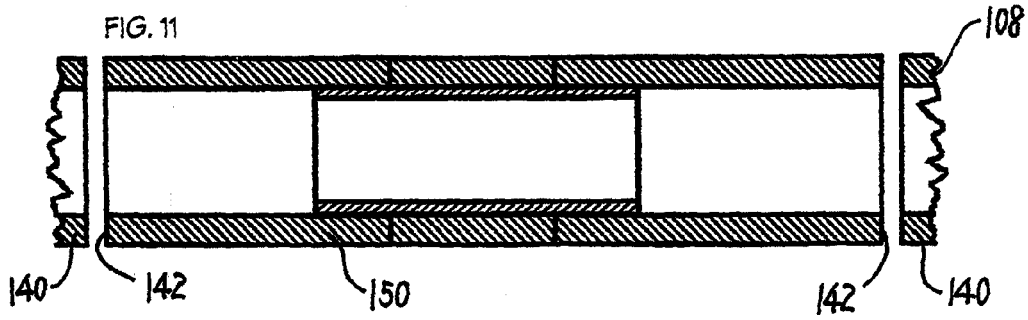
FIG. 11 is a schematic side cross-sectional view of a finished and rebuilt core with the damaged ends cutoff.
Figure 30:
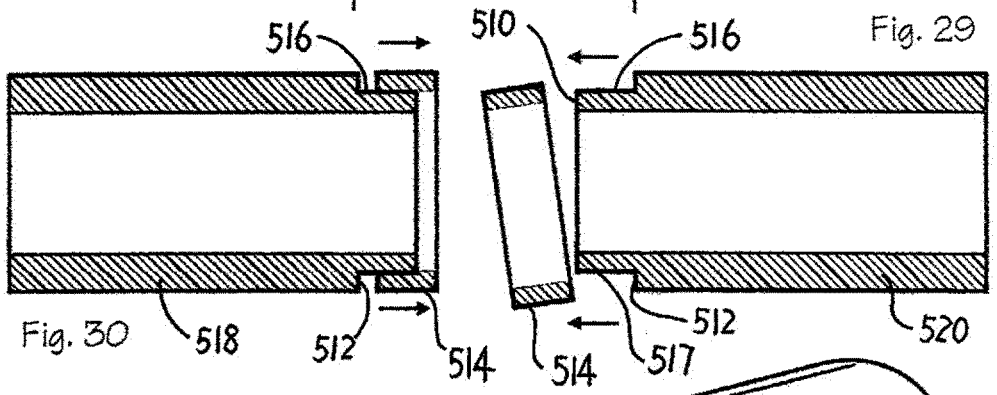
FIG. 30 is a side cross-sectional schematic view of a new spiral laminate paper core after being cut completely in half down the middle and partially cut through to the unglued parting line with loose discard rings shown being removed.
Figure 31:
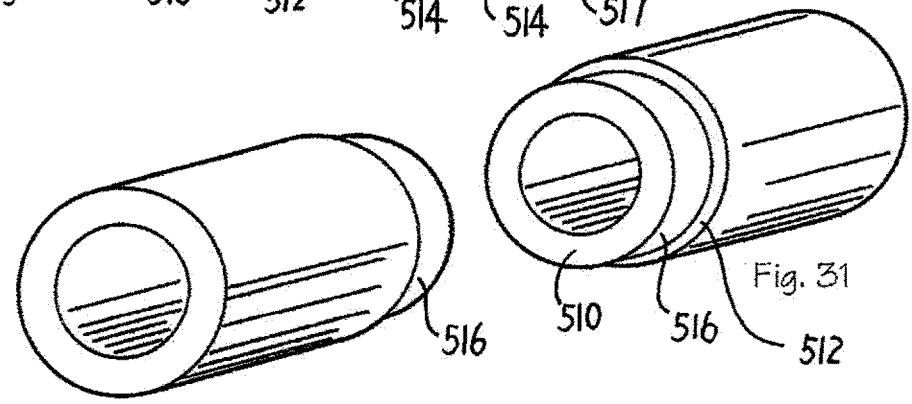
FIG. 31 is a schematic perspective view of a new spiral laminate paper core after being cut in half down the middle.
Figure 32:
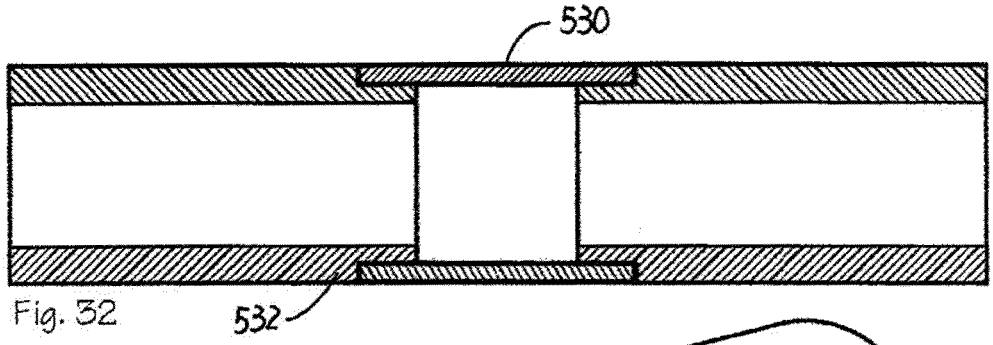
FIG. 32 is a schematic cross-sectional view of a new spiral laminate paper core lengthened using a joiner.
Figure 33:
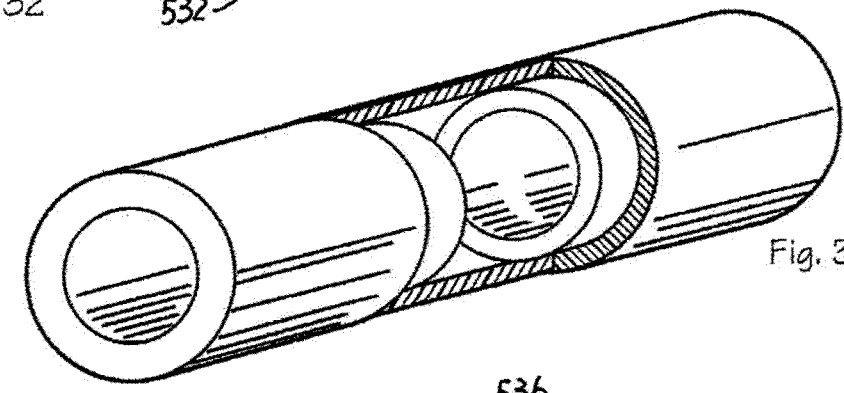
FIG. 33 is a schematic perspective view of a new spiral laminate paper core lengthened using a joiner.

Referring now to FIGS. 28 to 35 which depicts a new spiral laminate paper core namely central split core 502 having a central partial unglued parting line 504, sometimes referred to as "dry ply", at only a central portion 506 of central split core 502. The unglued parting line extends along only a central portion 506 of the total length of the central split core 502 rather than along the entire length as depicted as unglued parting line 402 in FIG. 27. The central portion 506 is defined for the purposes of this application as a parting line extending within 30% of length of either side of the longitudinal center of a used core 120 when measured before the damaged ends have been removed. It will be apparent to the reader that the damaged ends 108 as depicted in FIGS. 9 through 11 have already been removed as described above. The central split core 502 is depicted in FIG. 30 after being cut completely through the central portion 506 at cut 510 and partially cut through to the unglued parting line 504 at partial cuts 512. Loose discard rings 514 are shown being removed as they slide off of the unglued parting line 504. This creates either exterior lap cut out 517 and shoulders 516 and left core 518 and right core 520.

Referring now to 32 top 35 a joiner is placed in between left core 518 and right core 520 and rigidly glued or otherwise attached to the left and right core 518 and 520 exterior lap cut out 517. In some applications this may be enough to complete the core extension and the rebuilt core 532 depicted in FIGS. 32 and 33 may in fact be the finished product.

Figure 34:
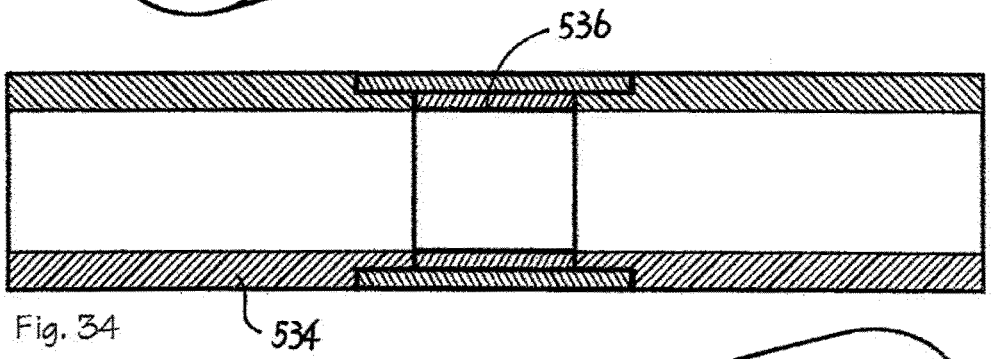
FIG. 34 is a schematic cross-sectional view of a new spiral laminate paper core lengthened using a joiner and a spacer.
Figure 35:
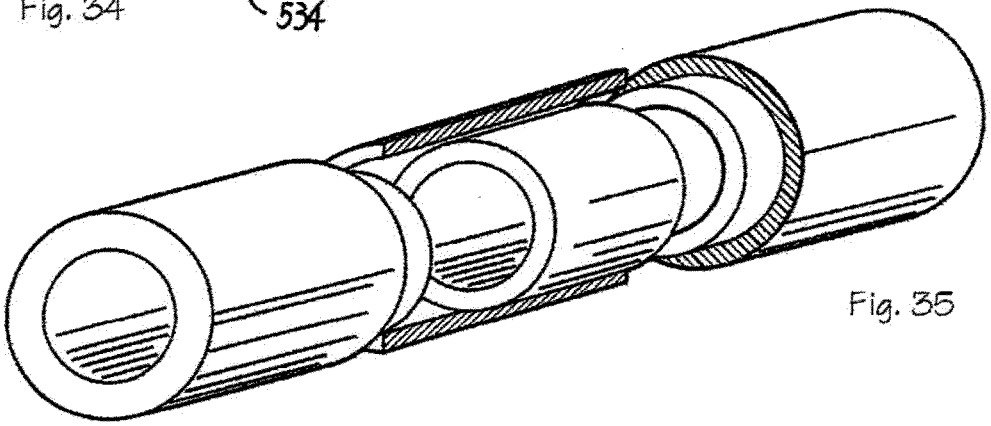
FIG. 35 is a schematic perspective exploded view of a new spiral laminate paper core lengthened using a joiner and a spacer.

In cases where additional strength is required an additional spacer 536 is added between the cut surfaces 510 as shown in FIG. 34. This produces rebuilt core 534 which is a completely refurbished core ready for reuse. Rebuilt core 534 includes an outer joiner 530 and an inner spacer 536 which may be two separate components as depicted or a single extension unit wherein the spacer and joiner are one integral unit.

It should be apparent to persons skilled in the arts that various modifications and adaptation of this structure described above are possible without departure from the spirit of the invention the scope of which defined in the appended claim.

I claim:

1. A method of rebuilding used cores comprising the steps of;

a') selecting a used core which is a split core with a substantially uniform outer diameter, a) cutting the used core substantially down the center at a midway cut thereby creating a left core and a right core, b) installing an extension unit in between the left core and right core thereby forming a lengthened rebuilt core wherein the outer diameter of the rebuilt core is uniform and the same as the outer diameter of the used core, c) cutting the damaged ends off the rebuilt core to a selected finished length.

2. The method of rebuilding used cores claimed in claim 1 wherein step a') is inserted before step a) as follows:

a') selecting a used core which includes insert collars in each end.

3. The method of rebuilding used cores claimed in claim 1 wherein step b) is replaced with the following step;

b') installing an extension unit, which includes a joiner and a spacer, between the left core and right core thereby forming a lengthened rebuilt core.

4. The method of rebuilding used cores claimed in claim 1 wherein step a') is inserted before step a) as follows:

a') selecting a used core which is a central split core.

* * * * *